US006125777A

United States Patent [19]

Vollebregt et al.

[11] Patent Number: 6,125,777

[45] Date of Patent: Oct. 3, 2000

[54] STRIP SEWING APPARATUS AND METHOD

[76] Inventors: Richard Vollebregt, 4 Kerr Shaver Terrace, Bradford, Ontario, Canada, L3E 1Z3; John Vollebregt, 60 Devon St., Brantford, Ontario, Canada, N3R 1M4; Milan Badovinac, 4173 Highgate Crescent, Mississauga, Ontario; Charles Gower, 6910 Kalar, Unit 16, Niagara Falls, Ontario, both of Canada, L4W 3G8; Roy James Clark, 14 Dowsview Court, Brantford, Ontario, Canada, N3R 7R3; Dietmar Jeske, 66 Cambridge Court, Bradford, Canada, L3E 1Z3; Brendan Conlon, 9 Holbrook Court, Unionville, Ontario, Canada, L3T 1Y9

[21] Appl. No.: 09/118,995

[22] Filed: Jul. 20, 1998

[51] Int. Cl.[7] ..... D05B 3/18; D05B 35/06

[52] U.S. Cl. ..... 112/152; 112/475.14; 112/304

[58] Field of Search ..... 112/2.1, 104, 113, 112/470.12, 470.33, 470.36, 152, 475.07, 475.14, 475.08, 304, 305, 307

[56] References Cited

U.S. PATENT DOCUMENTS

| | | | |
|---|---|---|---|
| 1,607,532 | 11/1926 | Halberg | 112/152 |
| 3,371,630 | 3/1968 | Cash, Jr. | 112/2.1 X |
| 3,874,311 | 4/1975 | Kenney . | |
| 3,970,014 | 7/1976 | Chano et al. . | |
| 4,013,027 | 3/1977 | Cash | 112/2.1 X |
| 4,192,241 | 3/1980 | Reed et al. . | |
| 4,261,080 | 4/1981 | Ryan . | |
| 4,344,210 | 8/1982 | Ryan . | |
| 4,425,858 | 1/1984 | Hargett . | |
| 4,582,006 | 4/1986 | Yamane . | |
| 4,611,546 | 9/1986 | Miyakawa | 112/113 X |
| 4,651,658 | 3/1987 | Vogel | 112/305 X |
| 4,905,615 | 3/1990 | Pofferi | 112/2.1 |
| 4,920,902 | 5/1990 | Takenoya et al. . | |
| 4,969,410 | 11/1990 | Brower et al. . | |
| 4,982,677 | 1/1991 | Nomura et al. . | |
| 5,054,409 | 10/1991 | Schips . | |
| 5,125,350 | 6/1992 | Frye et al. | 112/113 |
| 5,261,341 | 11/1993 | Asano . | |
| 5,323,723 | 6/1994 | Askin . | |
| 5,359,949 | 11/1994 | Asano . | |
| 5,386,789 | 2/1995 | Futamura et al. . | |
| 5,529,005 | 6/1996 | Saotome et al. | 112/305 X |
| 5,544,599 | 8/1996 | Frazer et al. . | |

FOREIGN PATENT DOCUMENTS

| | | |
|---|---|---|
| 220368 | 6/1987 | European Pat. Off. . |
| 3506444 | 3/1985 | Germany . |

*Primary Examiner*—Ismael Izaguirre

[57] ABSTRACT

A sewing machine for attaching tapes to a web includes a web feed station, a sewing station and a transfer mechanism to transfer the web from the sewing station to a collection zone. The sewing station includes a sewing head that moves across the web to sew the tape. The tape has hooks periodically spaced along the tape and movement of the sewing head is initiated by sensing one of the hooks at a predetermined locator. Successive tapes may then be sewn with the hooks aligned.

35 Claims, 14 Drawing Sheets

STRIP SEWING APPARATUS AND METHOD

FIELD OF THE INVENTION

This invention relates generally to a method and apparatus for attaching fittings at known locations to a large sheet or web.

BACKGROUND OF THE INVENTION

It is well known to suspend a cover over a crop to prevent damage by frost, to control sunlight or for other reasons. These coverings or curtains may be in the form of long sheets, or webs, which are suspended by rows of hooks from suspension wires. The hooks in each row are attached to a continuous band, and a series of bands are sewn in spaced parallel relationship to an underlying sheet material which forms the body of the cover.

At present these covers may be made by sewing the bands in place by hand and subsequently inserting the suspension hooks, a laborious task when producing a cover, or series of covers, for thousands of square feet of fields. As a suspension wire is eventually to pass through a series of hooks, each band must be sewn in a straight line. Moreover since the curtain cannot be held taught when deployed it will inevitably sag and form troughs between adjacent hooks. If the cover is to hang evenly and straight without twists or uneven stress, the spacing between successive hooks must be uniform and the hooks in adjacent rows must be aligned in a direction normal to the bands. Thus it is advantageous to be able to fasten the hooks to the cover not only quickly, so that covers of reasonable size can be made efficiently, but also with the requisite alignment.

It is therefore an object of the present invention to provide an apparatus and method in which the above desideratum are attained.

SUMMARY OF THE INVENTION

In the present invention sewing a machine apparatus to sew a tape having attachments located periodically therealong to a web, said apparatus comprising a web feed station to feed a web of material along with a predetermined path, a sewing station having a sewing head and a drive to move said sewing head in a direction transverse to said predetermined path, a tape dispenser associated with said sewing head to deliver a tape to said sewing head for attachment to said web, a transfer mechanism to transfer said web from said sewing station to a collection zone and a control to control operation of said drive, said control including a sensor disposed between said tape dispenser and said sewing head to sense the passage of an attachment and initiate operation of said drive.

According to a further aspect of the present invention there is provided a sewing apparatus for sewing a tape to a web of material, said apparatus including a web feed station to feed a web of material along a predetermined path, a sewing station including a sewing head to attach said tape to said web and a drive to move said head transverse to said predetermined path, a transfer station to move said web from said sewing station to a collection zone, said web feed station including a first support for a first roll of web material and a second support for a second roll of web material, each of said rolls delivering a respective strip of web material with said supports arranged to deliver said web material to said sewing station in side by side relationship, said sewing head traversing each of said strips to secure said tape thereto and form a unitary web.

According to a still further aspect there is provided a sewing apparatus to sew a tape to a web, said apparatus comprising a web feed station to feed said web of material along a predetermined path, a sewing station having a sewing head and a drive to move said head in a direction transverse to said predetermined path, a tape dispenser associated with said sewing head to deliver a tape to said sewing head for attachment to said web, and a transfer mechanism to transfer said web from said sewing station to a collection zone, said sewing head carrying a supplementary mechanism to perform supplementary operations on said web as said head traverses said web.

In an additional aspect there is provided a sewing apparatus to sew a tape to a web, said apparatus including a web feed station to feed a web of material along a predetermined path, a sewing station having a sewing head and a drive to move said sewing head in a direction transverse to said predefined path, a tape dispenser to deliver a tape to said sewing head to attachment to said web, and a transfer mechanism to transfer said web from said sewing station to a collection zone, said sewing station including a pair of rails extending transversely to said predetermined path, a carriage supported on said rails by a pair of wheel assemblies, and a pedestal to mount said sewing head, said drive being operable to move said carriage along said rails to sew said tape to said web.

As a further aspect there is provided sewing apparatus for sewing a tape having attachments located periodically therealong to a web of material, said apparatus including a web feed station to feed a web of material along a predetermined path, a sewing station including a sewing head to attach said tape to said web and a drive to move said head transverse to said predetermined path, and a transfer station to move said web from said sewing station to a collection station, said collection station including a roll forming device to receive one end of said web and form it to a roll. In a still further aspect there is provided a method of securing a tape having hooks disposed periodically along said tape to a web, said method comprising the steps of securing said hooks to said tape, advancing said tape with said hooks through a sewing head disposed adjacent said web, and advancing said sewing head across said web while performing a sewing operation between said tape and web to secure said tape to said web.

DESCRIPTION OF THE DRAWINGS

Embodiments of the present invention will now be described by way of example only with reference to the accompanying drawings in which.

A PREFERRED EMBODIMENT OF THE INVENTION

Figure 1:
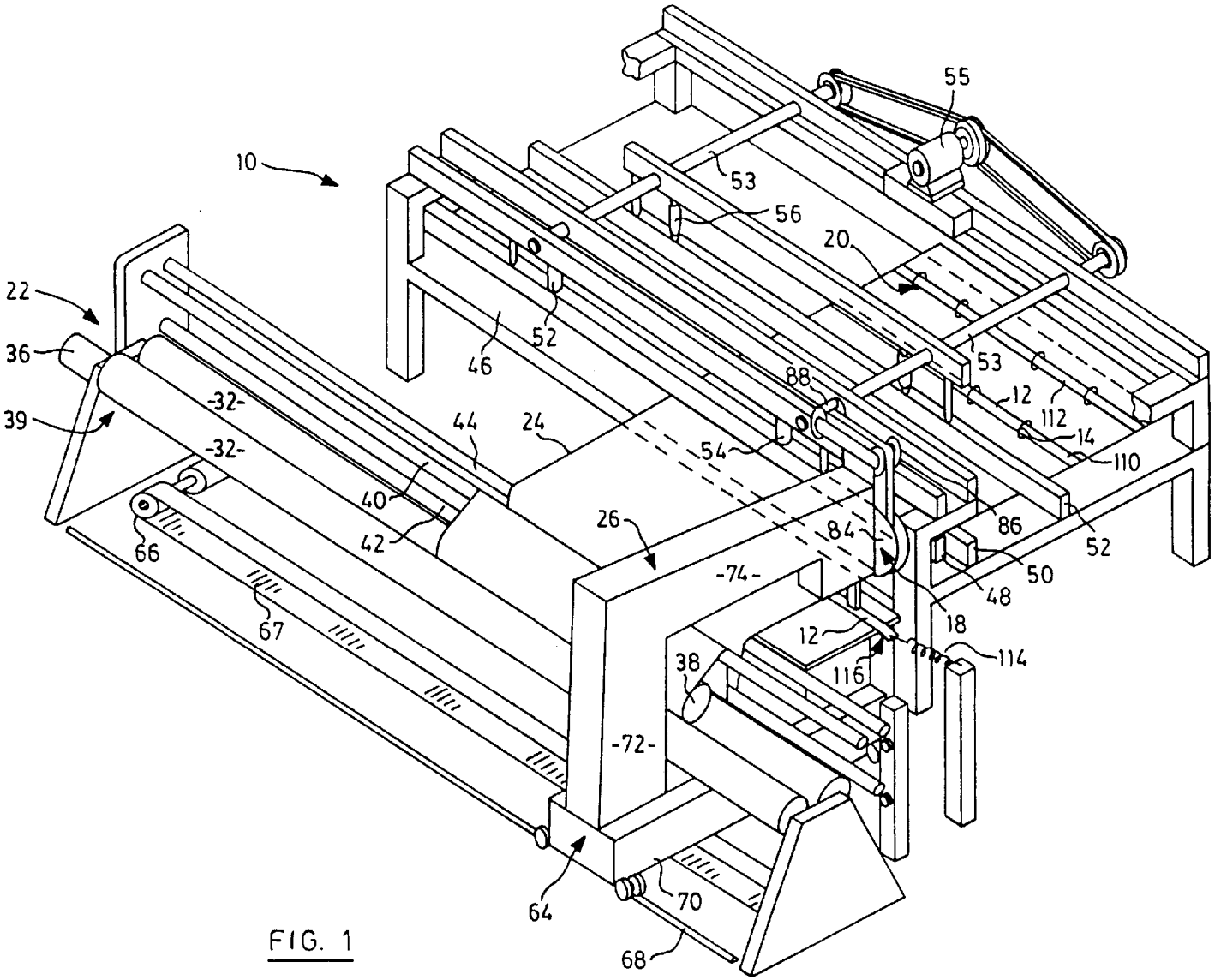
FIG. 1 is a general arrangement an embodiment of a machine for attaching hooks to a cover.

In the description which follows, like parts are marked throughout the specification and the drawings with the same respective reference numerals. The drawings are not necessarily to scale and in some instances proportions may have been exaggerated in order more clearly to depict certain features of the invention.

Referring therefore to FIG. 1 a machine 10 attaches a tape 12 having hooks 14 located at spaced intervals to a web 24. The curtain produced is indicated generally as 20 and may be used in combination with a support structure as more fully shown in U.S. Pat. No. 5,581,954. The machine 10 includes a web feed system 22 for dispensing a web 24 from a roll 38, a tape dispenser 18 and a sewing apparatus 26 which attaches a tape 12 to the web 24.

Web feed system 22 has an in-feed, generally indicated as 39, having a pair of parallel support rollers 32 mounted on a suitable stand 34 and driven by a roller drive 36. The web 24 is constituted by a single strip of fabric wound into a roll indicated as 38 placed upon and between rollers 32 such that web 24 is unwound as rollers 32 are rotated. Web 24 is entrained over a first fixed fabric support 40, a floating dancer 42, and then over a second fixed fabric support 44 before being delivered to sewing apparatus 26, more fully described below. Dancer 42 maintains a nominal tension in the web 24 as it is dispensed. Having passed sewing apparatus 26, web 24 is transferred by a transfer station 45 to a collection zone 47.

Transfer station 49 moves the web across a support table 46 by a pull bar 51 whose operation is more fully described below. Primary and secondary hold bars 48 and 50 are movable in the vertical direction by pneumatic cylinders 49 and 51. Cylinders 52,54 may be extended to force the bars 49,51 downward and clamp web 24 against table 46 to hold web 24 stationary. Retraction of the cylinders 48,50 moves the bars upward to release web 24 and allow it to slide along the table 46.

Similarly, pull bar 52 is provided with a pair of pneumatic cylinders 56 by which it can be driven downwardly to engage web 24, or upwardly to release it. Pull bar 52 is connected to a pair of lead screws 53 that are supported above the table 46 and conjointly rotatable by motor 55. As the screws rotate, the bar 52 is moved along the table either toward the in-feed station or away from it depending on the direction of rotation of the screws. By coordinating the operation of the bars 48,50,52 and the lead screws 53 the web 24 may be advanced in a controlled manner along a predetermined path.

The sewing apparatus 26 is supported on a wheeled carriage 64 that may move along rails 68 in a direction transverse to the feed of the web. A carriage drive 66 operating on a toothed belt 67 secured to the carriage 64 controls movement along the rails 68 from a home, or datum position, as indicated in solid lines in FIG. 1. A pedestal 70 and a pillar 72 are located on the front and rear portions of carriage 64 respectively for movement with the carriage 64. A cantilevered arm 74 extends forwardly from pillar 72 and carries an upper sewing machine head assembly, indicated generally as 76 at the distal end. A lower sewing machine head assembly, indicated generally as 78 mounted on the pedestal 70 opposite the assembly 76 so that they cooperate to perform a sewing operation on material located between them. The upper and lower sewing machine head assemblies are industrial sewing machine mechanisms of suitable known construction.

The lower assembly 78 has a plate 80 for supporting web 24 as it is deployed from the roll 38. As will be noted, the bight bounded by cantilevered arm 74, pillar 72 and carriage 64 accommodates rollers 32 and roll 38 such that as web 24 is paid out it can pass over platen 80 and between sewing head assemblies 76 and 78.

Figure 4:
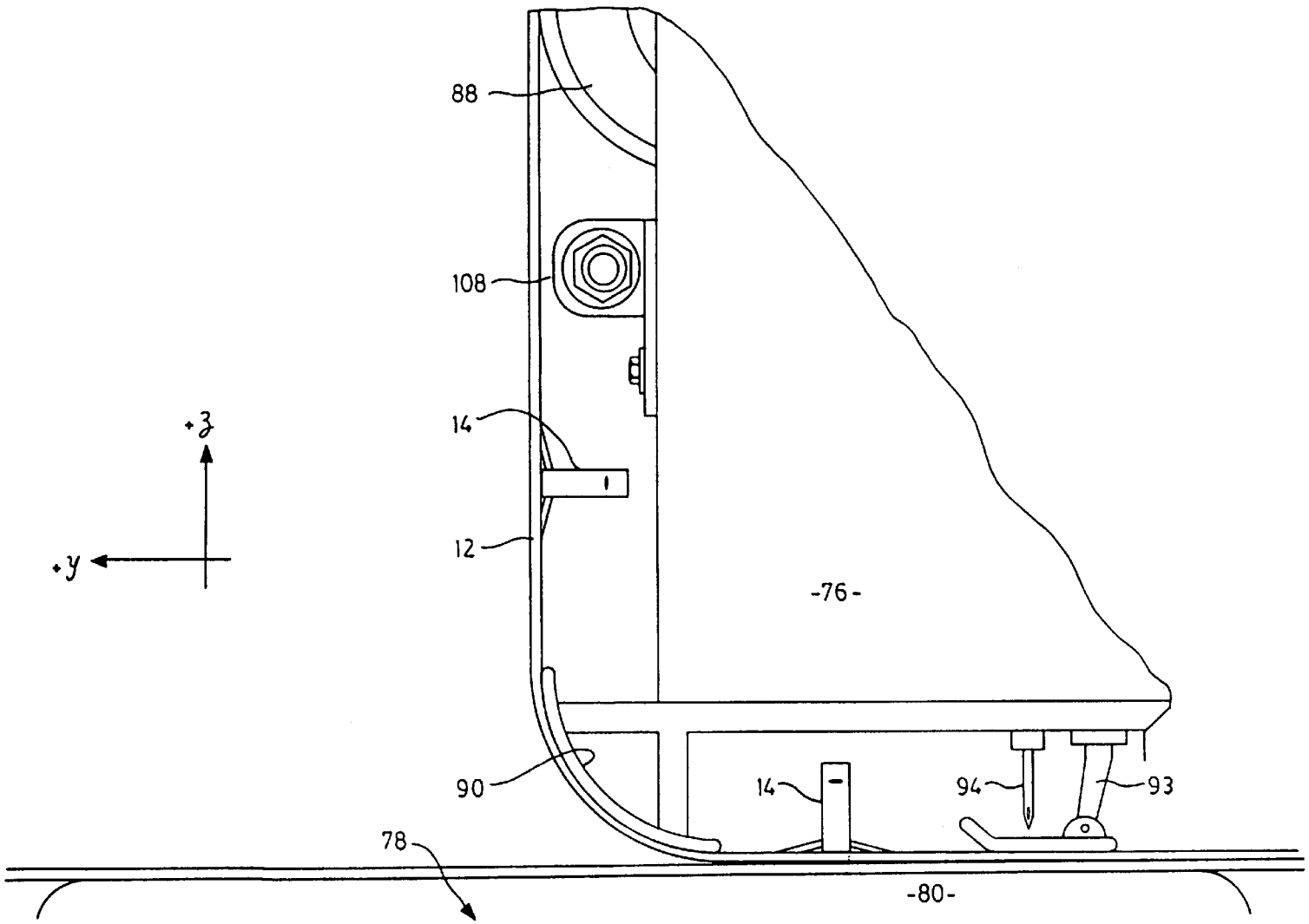
FIG. 4 is a view on the line 4—4.

Tape dispenser 18 is mounted to the distal end of cantilevered arm 74, and includes a tape reel 84, idlers 86,88 and an in-feed guide 90 as best seen in FIG. 4. The idlers 86,88 and guide 90 are constructed to permit the hooks on the tape to pass between them and the tape laid flat on the web 24.

Figure 3:
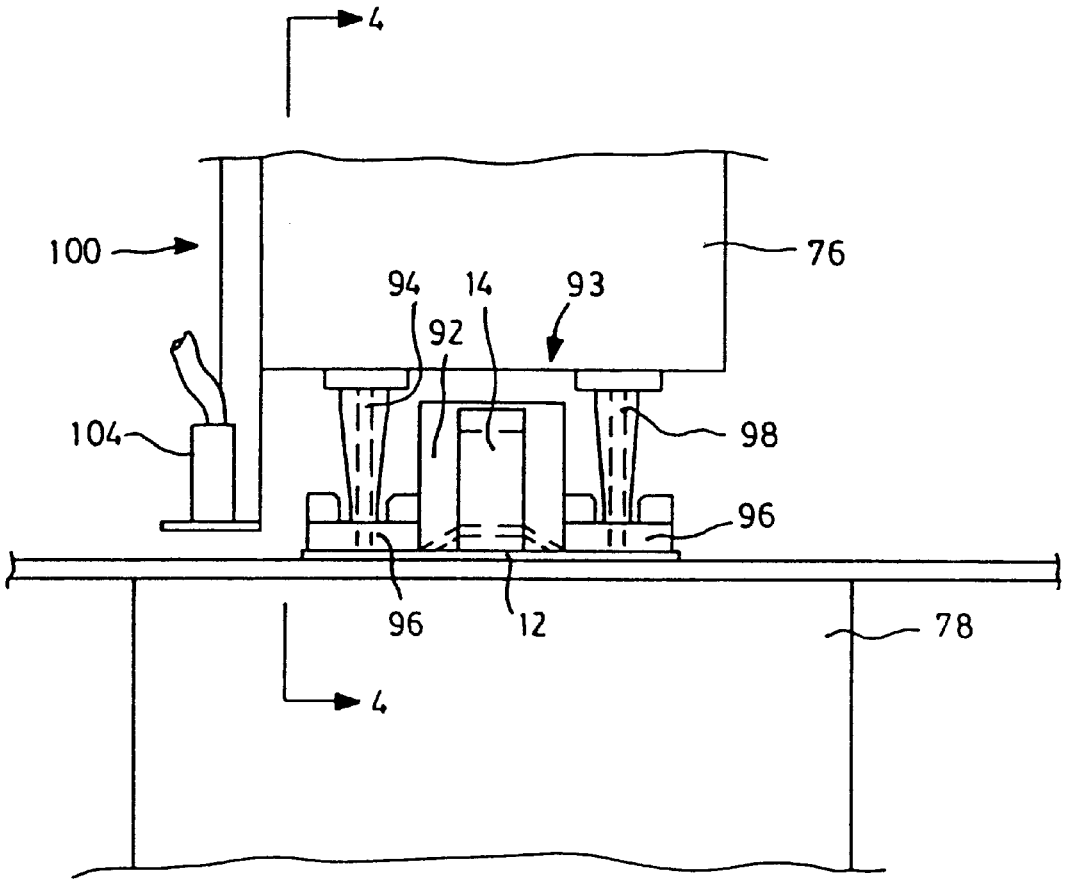
FIG. 3 is an end view of a sewing head used in the machine of FIG. 1.

Referring to FIG. 3 in-feed guide 90 presents the tape to a cavity 92 located centrally within a foot 93. The foot 93 has a pair of laterally spaced holes 96 positioned on opposite edges of the tape 12, Needles 94,98 reciprocate in respective holes relative to the foot 92 in known manner to sew a seam and attach a respective edge of pre-hooked tape 12 to web 24. As shown in FIG. 3, the cavity 92 is of sufficient size to permit passage of hooks 14 folded flat against the tape 12 so that the tape complete with hooks may be sewn to the web.

Figure 5:
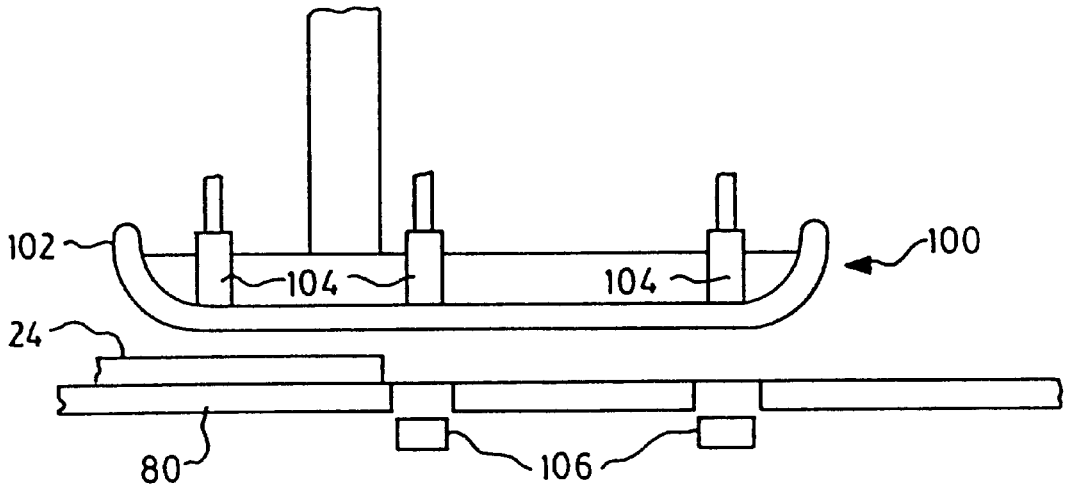
FIG. 5 is a side view in the direction of arrow V of FIG. 3.

The initial position of the carriage 64 is controlled by a sensing head 100 shown in FIG. 5 and carried by sewing machine head assembly 76. Sensing head 100 includes a shoe 102 extending parallel to the platen 80 with three infrared transducers 104 at spaced locations along the shoe 102. Pickups 106 are mounted in the platen 80 in alignment with respective ones of the transducers 104. The web 24 covers the pickups 106 during transverse movement of platen 80 with the sewing station 26. Upon reaching an edge of the web, the pickups are exposed and control movement of the carriage as described below.

Referring again to FIG. 4, an optical sensor 108 is adjustably mounted to upper sewing head assembly 76, and is used to control the operation of carriage drive 66. As hooks 14 proceed from idler 88 to in-feed guide 90 they extend outwardly from pre-hooked tape 12 sufficiently far to eclipse optical sensor 108, thus changing its output state. The change in state initiates operation of the motor and moves assembly 26 along the rails 68. The path length from sensor 108 to the needles 94 and 98 is constant for a given web, as is the spacing of the hooks along the tape. Accordingly, the position of a hook relative to the needles 94,98 and thus relative to the datum position of the sewing apparatus, is known when the hook passes the sensor 108. By controlling the translation of the heads from the hook, a consistent placement of the first and subsequent hooks relative to the edge of the tape is obtained. The position of the sensor 108 may be adjusted so that the first hook is at the desired location relative to the edge of the tape.

The operation of machine 20 will now be described, assuming a web of chosen width 'W', a desired hook pitch along the web of 'P', an initial hook inset distance of 'D', and a span S between adjacent parallel bands of pre-hooked tape 12. As shown in FIG. 1, two bands *110 and *112 of tape 12 have already been sewn to web 24, which is stationary, being held in tension between second fixed fabric support 44 and one of holders 48 or 50, as the case may be. Carriage 64 is in its home, or datum position relative to the known position of one edge of web 24. The sensing head 100 positions the needles 94,98 outboard of the edge of the web 24 so that the central sensor 104 is uncovered. In this position the needles 94,98 are free to reciprocate without engaging the web 24.

The operation is initiated by activating the sewing head, causing tape 12 to be fed between upper and lower sewing head assemblies 76 and 78. Needles 94 and 98 reciprocate, merely sewing in tape 12. As can be seen in FIG. 1, a spring 114 is connected at one end to a stationary frame and at the opposite end to a barb 116 engaged in the tape 12. Spring 114 applies tension to the tape 12 to advance it past the needles 94,98. One of hooks 14 passes sensor 108, initiating carriage drive 66 to drive carriage 64 along the rails 68 and traverse to the web 24. As it does so pre-hooked tape 12 is sewn along both seams by needles 94,98 locating hooks 14 in place.

Prior to operation, the location of the first hook at initial distance "D" is assured by adjusting the position of optical sensor 108 upward or downward as desired. Given the known distance to the edge of web 24, the fixed pitch "P" of hooks 14 and the fixed geometry of the path length to be traveled by tape 12, the setting of optical sensor 108 will yield a repeatable placement of the first hook in each successive row. When the far edge of web 24 is approached the first sensor 104 is uncovered. The carriage 64 is decelerated and the sewing continues a short distance until the intermediate sensor is uncovered. At that time, carriage 64 is stopped clear of web 24, sewing stops, and tape 12 is cut. The sensing of the edge of the web 24 by the head 100 is used to stop the needles 94, 98 in a retracted position clear of the web 24. An encoder on the drive to the needles indicates the retracted position and thereby allows the sewing heads to be returned to the opposite edge.

Figure 6:
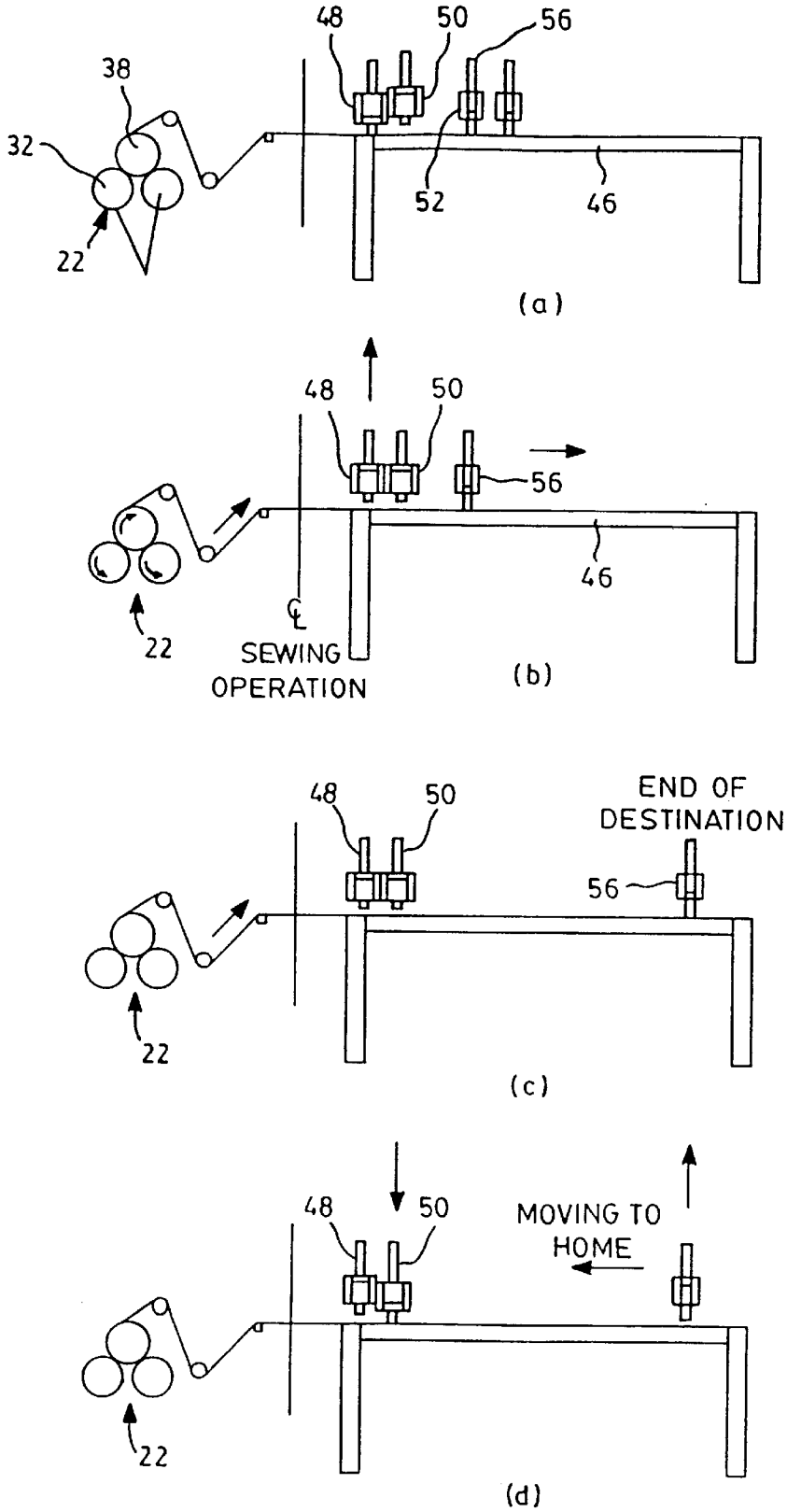
FIG. 6 is a schematic illustration of the sequence of operations performed by the machine of FIG. 1.

The web 24 is now ready to be advanced as shown in FIG. 6. During sewing, one of the bars 48,50 engages the web and inhibits movement of the web 24. A pair of bars are provided so that different pitches of tape placements may be accommodated without the risk of the bar 48,50 engaging the hooks. Similarly, the pull bar 52 is engaged with the web 24. When the sewing is complete, the bar 48,50 is raised as shown in FIG. 6*b* and pull bar 52 is advanced through span distance 'S' to its destination, or furthest position away from secondary hold bar 50 by rotation of lead screws 53. As the contact between pull bar 52 and web 24 is non-sliding and the contact between web 24 and surface 58 is one of sliding contact, the advance of pull bar 52 necessarily causes a corresponding advance of web 24. If this advance causes weight member 42 to rise sufficiently, upper limit switch 60 will activate feed roller drive 36 causing the web 24 to be dispensed. The drive 36 will continue to dispense the web 24 until the weight member 42 activates lower switch 62. In this way, web 24 may be dispensed as it is moved across the table. When pull bar 52 reaches its second end, or destination position and stops, one of the hold bars 48,50 is lowered to engage web 24 in non-sliding contact, holding it in place. If a row of hooks 14 lies directly beneath primary hold bar 48 then it will not be lowered but rather secondary hold bar 50 will be used to engage web 24 as shown in FIG. 6*c*. With web 24 thus held, pull bar 52 can be raised and returned to either its home or alternate home position. Again if a row of hooks 14 lies in the home position, then pull bar 52 will be moved to the alternate home position before engaging web 24 thus avoiding crushing any hooks.

Once web 24 has advanced, carriage 64 is returned to its home position as sensed by the intermediate sensor 104. While it is preferred to return carriage 64 to its home position after web 24 has advanced, carriage 64 could also be returned either before or during the advance of web 24. Once carriage 64 has returned, the cycle may recommence. With web 24 held still, carriage 64 will stand stationary as tape 14 is fed between assemblies 76 and 78 until such time as optical sensor 108 experiences a change of state from which it can be inferred that the first of hooks 14 is in the chosen position relative to web 24. It will then repeat the operation described above.

Operation of the machine embodiment described in the manner described will sew parallel rows of hooks 14 to web 24 with known placement such that the hooks of adjacent rows will be in substantial alignment. It will be noted that web 24 is maintained in substantially uniform. Tension in the direction of advance under the influence of dancer 42 between second fixed fabric support 44 and one of holders 48 or 50, or pull bar 52 throughout the cycle. Although each of hold bars 48 or 50 or pull bar 52 engages web 24 along a continuous line of contact, and yields, optimally, a modest uniform stress field in web 24, a number of discrete contact pads, or multi-contact arrangement could also yield a substantially uniform stress field. Further, while linear contact is indicated perpendicular to the direction of advance, the shape of the contact need not traverse the web in a straight line, nor need the line be perpendicular, provided web 24 remains evenly spread. Similarly, it would not appear that table 46 need be flat, or continuous, provided that suitable support is provided by presenting web 24 in a manner suitable for mating with tape 12 and for permitting a fastening head, such as the combination of assemblies 76 and 78 to fasten hooks 14 in known position to web 24. Equally so, while tensioning under a constant weight has been found simple and convenient, other web tensioning devices may be employed.

In the case of primary and secondary hold bars 48 and 50, it is not necessary to have two such hold bars to avoid crushing hooks. For example, primary hold bar 48 could be permitted to move to an alternate home position just as pull bar 52 is already permitted to do. Further, a pair of pull bars, or more as desired, without any hold bars, could be used provided that web 24 remains adequately spread for relatively consistent and accurate fastening.

The above embodiment has described the operation of sewing parallel tapes to a web dispensed from a single roll. However, as shown in FIGS. 7–16 the apparatus may be adapted to handle multiple webs of material and perform supplementary operations on the web as sewing is performed.

In the further embodiment shown in FIGS. 7–16 like reference numerals will be used to denote like components with a suffix 'a' added for clarity. The general arrangement of machine 10*a* is similar to that shown in FIGS. 1 to 6 with a web feed system 22*a*, tape dispenser 18*a* and sewing apparatus 26*a*. Web 24*a* is transferred by transfer station 45*a* to a collection zone 47*a*. To the extent that the embodiment of FIGS. 7–16 is essentially identical to the embodiments of FIGS. 1–6, further description will not be provided.

Web feed station 22*a* includes a pair of rollers 32*a* supporting a first roll 38*a* of web material to deliver a first strip of material to the transfer table 46*a* as described above.

Figures 8, 9:
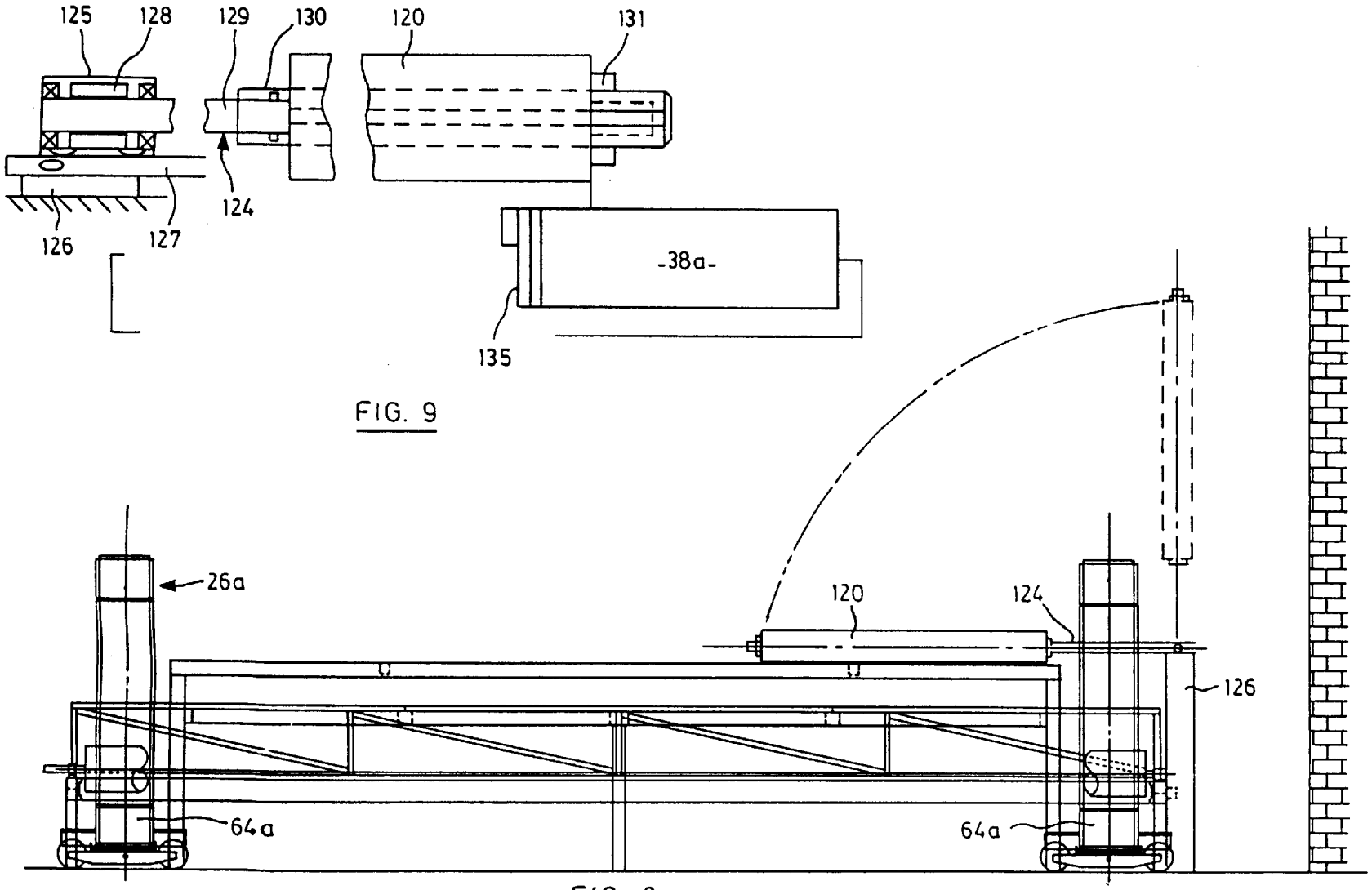
FIG. 8 is a front elevation of the machine shown in FIG. 7.
FIG. 9 is a rear view of a portion of the machine shown in FIG. 7.

As can be seen in FIG. 8, second roll 120 is supported above and to one side of the first roll 38*a*. The second roll 120 dispenses a second strip 122 of material to the transfer table 46*a* by passing it over fixed fabric supports 40*a*, 44*a* and a respective dancer 42[1]*a*. Second roll 120 is supported on a cantilevered roller assembly 124 pivotally connected to a mast 126.

Roller assembly 124 includes a housing 125 that is laterally adjustable on a pair of rails 127. The housing 125 includes a motor 128 that rotates a support shaft 129. A pair of clamps 130, 131 act between the shaft 129 and second roll 120 to locate it axially and cause it to rotate with the shaft 129.

Figure 10:
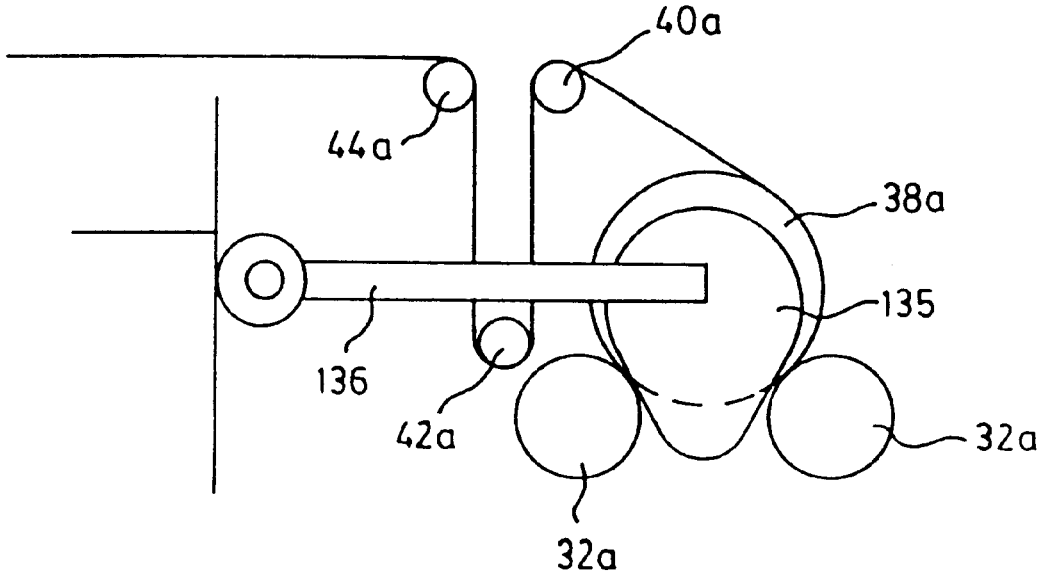
FIG. 10 is an end view of the portion of the machine shown in FIG. 9.
Figure 11:
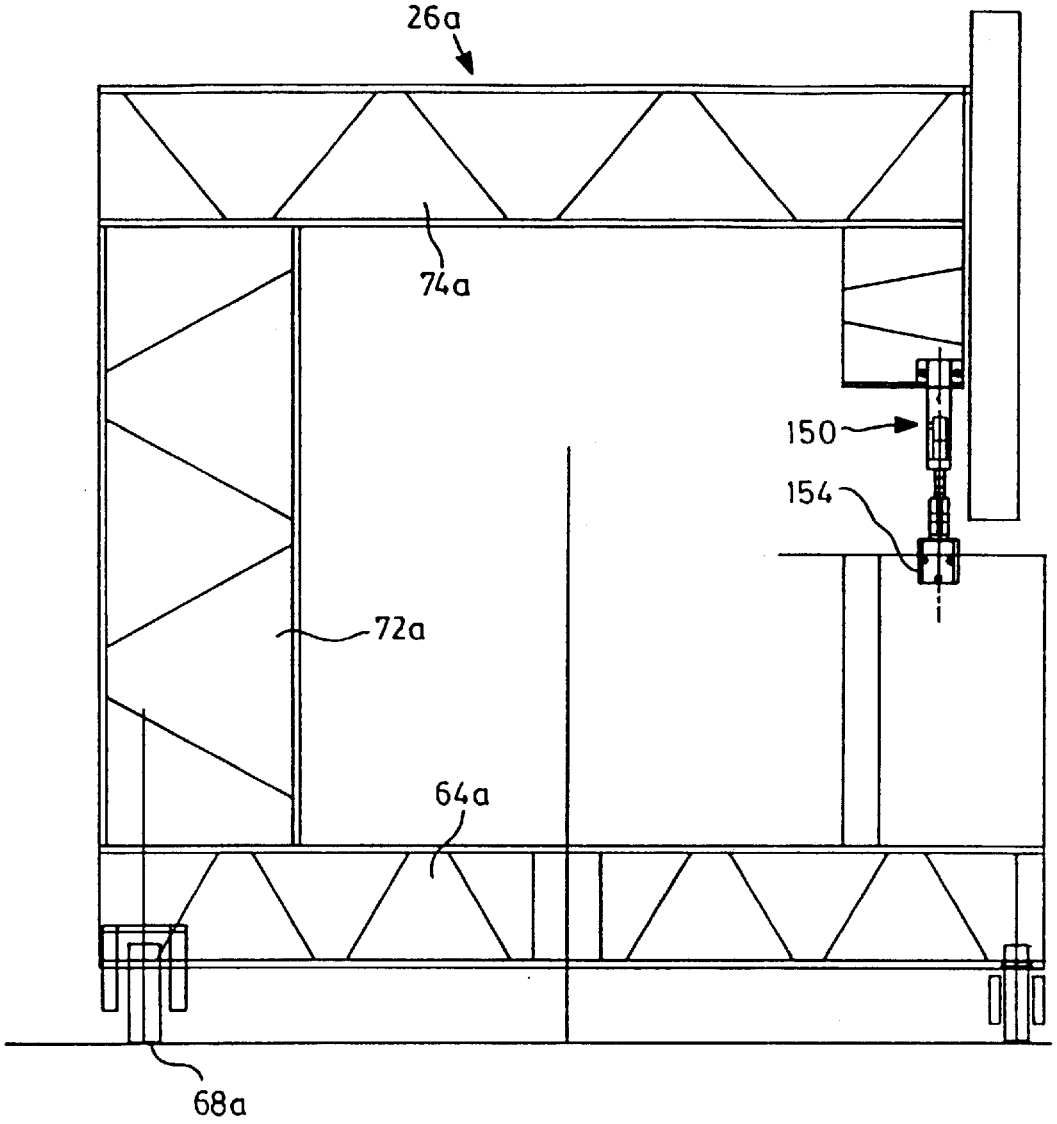
FIG. 11 is a side elevation of a further portion of the machine shown in FIG. 7.

The rolls 38*a*, 120 are positioned so the adjacent edges overlap and the degree of overlap may be adjusted by movement of the housing 125 relative to rails 127. This may be achieved by a worm drive or servo operated chain drive as convenient. As shown in FIGS. 9 and 10, the position of the edge of roll 38*a* is maintained by a guide plate 135.

Guide plate 135 is attached to an arm 136 that is slidably supported on the leading edge of the table 46*a* so as to be laterally adjustable. The guide plate is tear shaped to project in to the nip of the rolls 32*a* and maintains the edge of the roll 38*a* in a preset location. Variations in the width of the roll 38*a* are accommodated by the sensing head 100*a* associated with the sewing head 26*a* so that the first hook 14 on the tape 12 remains accurately positioned. The overlap between the webs is sensed by an optical sensor offset from the plate 135 and operating to adjust the lateral position to roll 120 via the housing 125.

Figure 12:
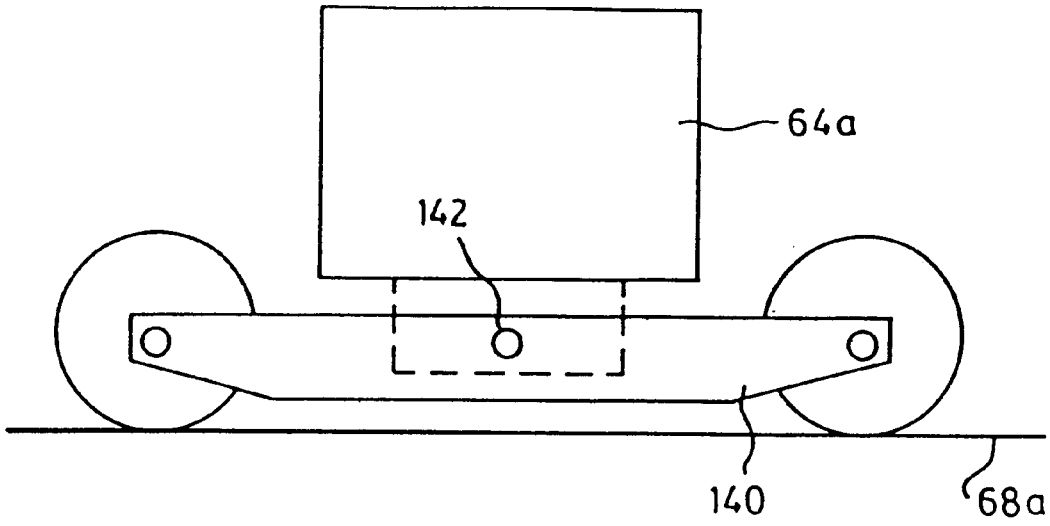
FIG. 12 is a front view in the direction of arrow A of FIG. 11.

The roller assembly 124 is located within the bight of arm 74*a*, pillar 72*a* and carriage 64*a* to permit the sewing station to traverse both rolls 38*a*, 120 as it moves along the rails 68*a*. The tape 12*a* is sewn successively to the strips to join them in a side by side relationship and form a unitary web. Movement along the rails 68*a* is facilitated by the mounting of the carriage 64*a* as shown in FIG. 12. One pair of wheels associated with one of the rails 68*a* are directly mounted to the carriage 64*a* but the other pair is mounted to a beam 140. The beam 140 is pivotally connected to a pin 142 for movement about an axis perpendicular to the rail 68*a*. Any unevenness in the rails is thus accommodated by relative movement between the beam 140 and carriage 64*a* to inhibit torsional loading of the carriage 64*a*, as it traverses the web 24*a* to attach the tape 12*a*.

The movement of the sewing station 26*a* is utilized to perform supplementary operations on the web 24*a* as the tape is attached. As shown in U.S. Pat. No. 5,581,954 certain applications of curtain require a drainage aperture at periodic locations on the curtain. These apertures are located in a valley of a pitched roof and allow water to drain through the roof into a gutter. The sewing station 26*a* is adapted to form these openings as the tape is sewn to the web 24.

Figure 7:
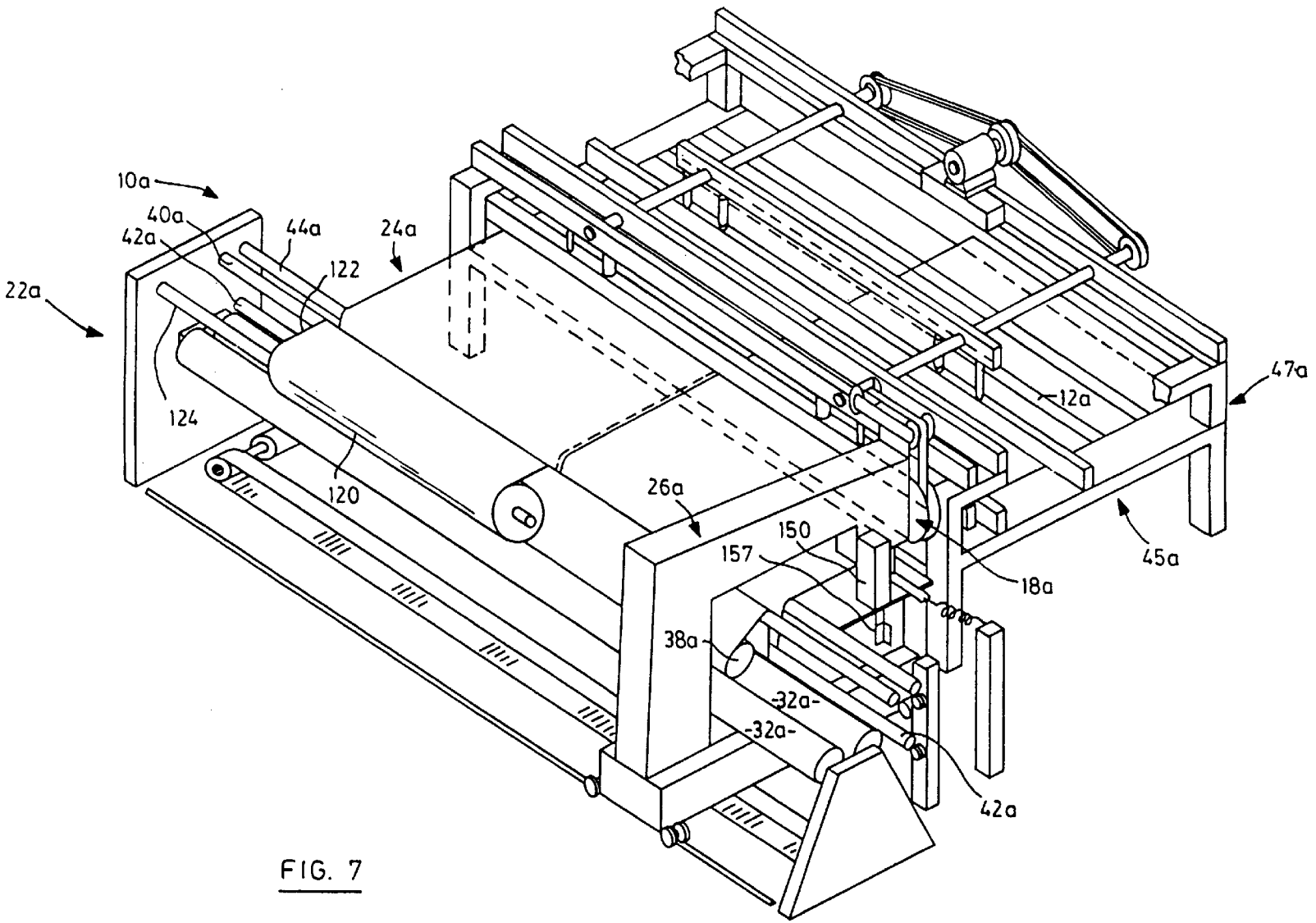
FIG. 7 is a perspective view of a further embodiment of the machine shown in FIG. 1.
Figure 13:
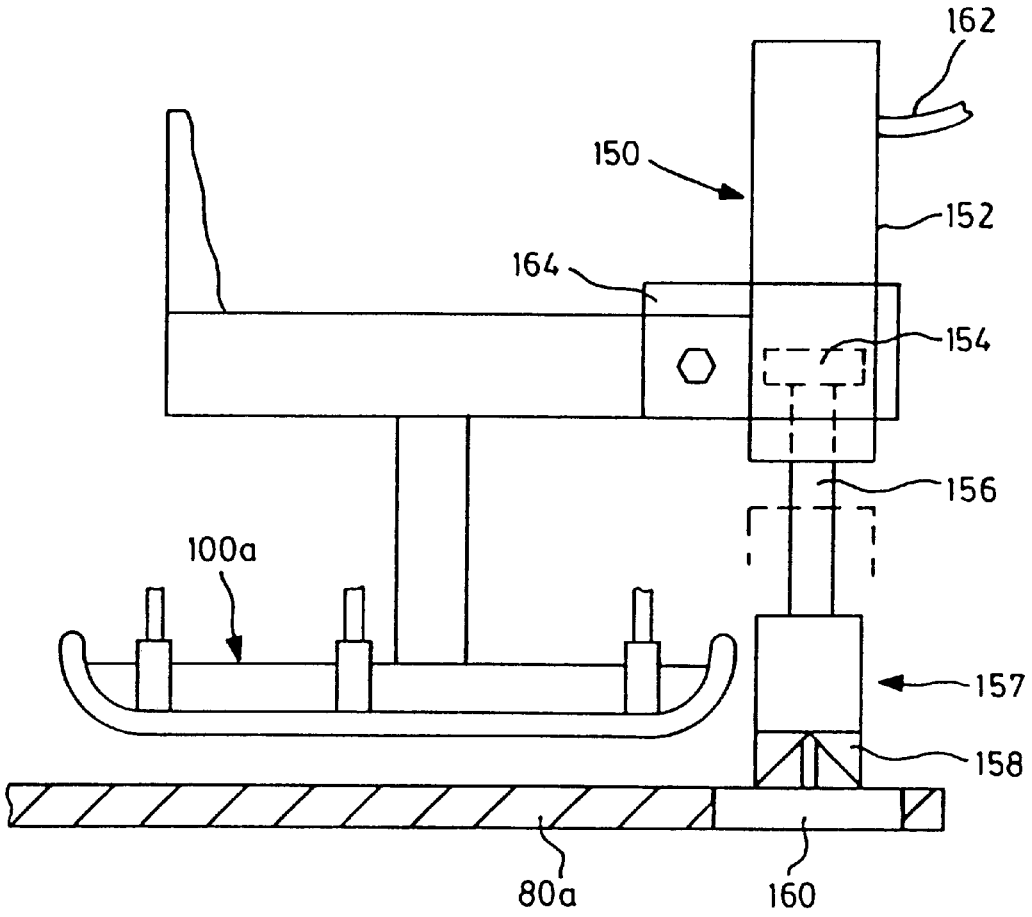
FIG. 13 is an enlarged view in the direction of arrow B of FIG. 12.

As can be seen in FIGS. 7 and 13 a pneumatic cylinder assembly 150 is mounted on the sewing head assembly 76*a*. Cylinder assembly 150 includes a cylinder 152 and a piston 154 secured to piston rod 156. A cutter assembly 157 is mounted at the lower end of the piston rod 156 and includes four blades 158 disposed at 90° to one another.

An aperture 160 is formed in the platen 80a in alignment with the cutter assembly 157. Extension of the piston 154 by admission of air through port 162 forces the cutter assembly through the web 24*a* to form slits in the web 24*a*. Of course alternative shapes of aperture could be formed in the web as required or alternative operations could be undertaken.

The cylinder assembly 150 is secured to the sewing head assembly 76*a* by a bracket 164, which maintains a predetermined offset from needles 96*a*, 98*a*. The offset in the direction of movement of the web 24*a* is selected for this particular application to be one half the spacing between the tapes 12*a* so that the apertures are centrally located between the tapes. The offset transverse to the direction of movement of web 24*a* is one half the spacing of the hooks on the tape 12*a* and the cylinder assembly is activated by sensing the displacement of the sewing station 26*a* along the rails.

Accordingly, as the sewing station traverses the web 24*a*, the cylinder assembly is activated periodically to pierce the web. Of course, this is only performed on those runs corresponding to a valley location on the curtain and the operation of the cylinder is inhibited at other times.

Figure 14:
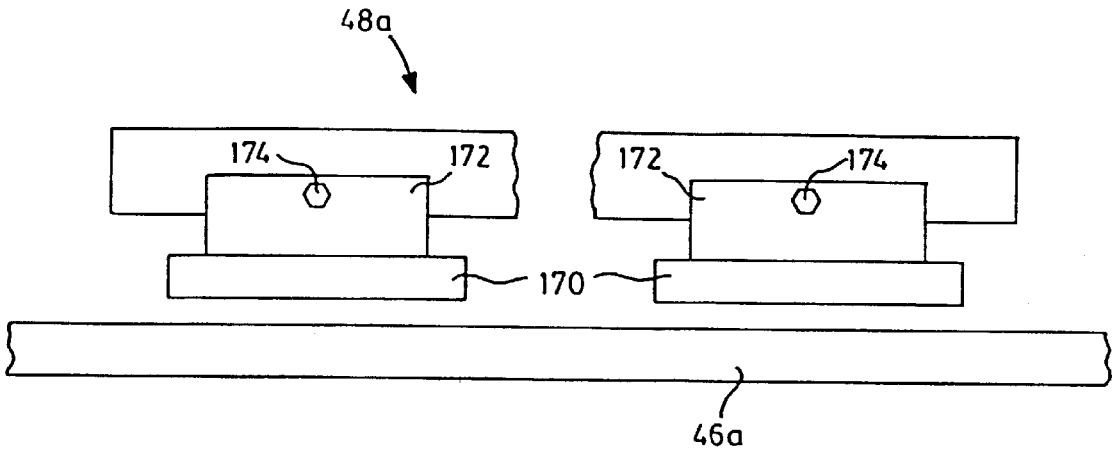
FIG. 14 is a detailed view of components of the machine shown in FIG. 7.
Figure 15:
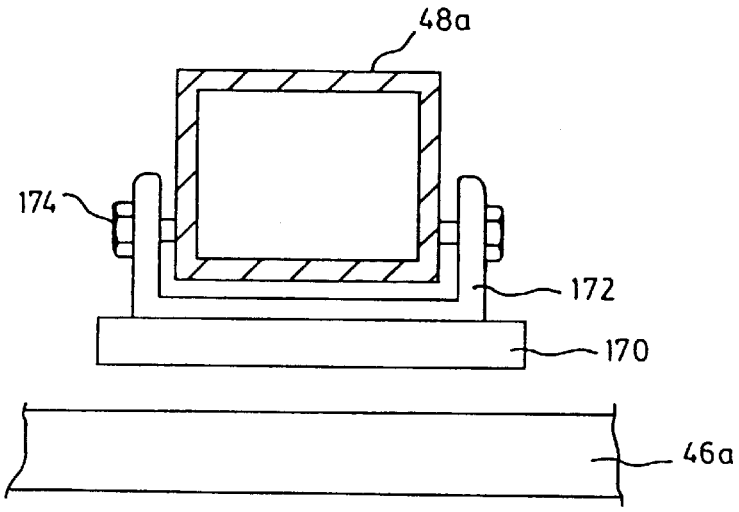
FIG. 15 is a view on the line XV—XV of FIG. 14.

As shown in FIG. 14, the clamps 48*a* and pull bars 52*a* are modified to facilitate different spacing of hooks 14*a*.

The arrangement of bars 48*a*, 52*a* is similar and therefore only one will be described. The bar 48*a* is provided with shoes 170 having upstanding ears 172 to fit on opposite sides of bar 48*a*. Set screws 174 secure the shoes 170 to the bars 48*a* so that they may be adjusted along the beam to suit the spacing of the hooks 14*a*.

Figure 2:
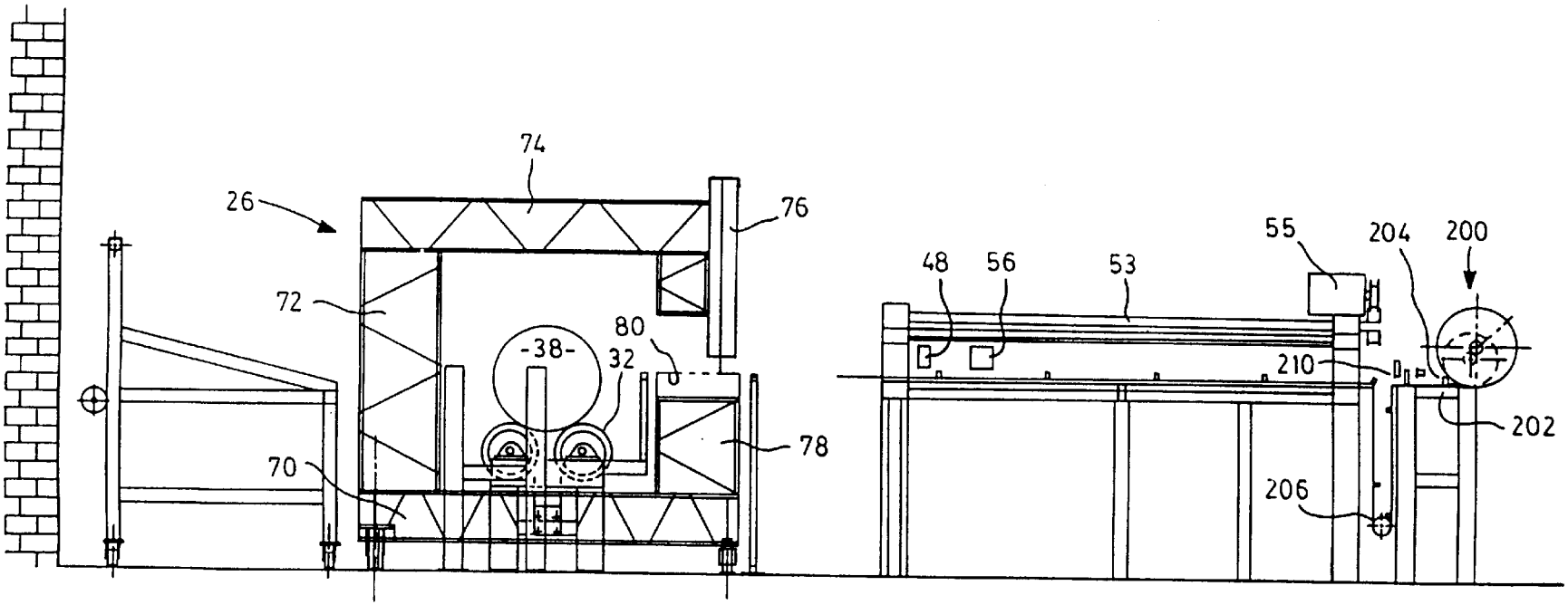
FIG. 2 is a side elevation of the machine shown in FIG. 1.
Figure 16:
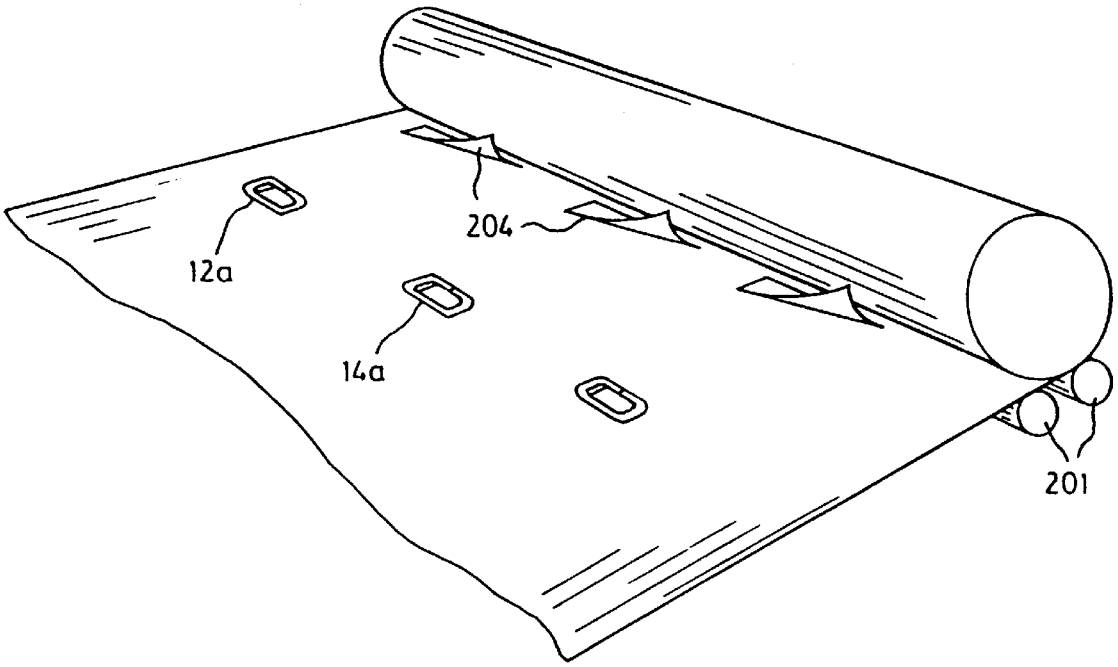
FIG. 16 is a perspective view of a collection station used with the machine of FIG. 7.

In either embodiment, an automated collection station may be utilized as shown schematically in FIGS. 2 and 16. Collection station 200 includes a table 202 aligned with table 46. A pair of driven rollers 201 at the rear of the table 202 receive the web 24 and roll it as it is delivered. Shoes 204 are located at the throat of the roll to lay the hooks 14 flat on the web prior to rolling. The underside of shoes 24 are curved progressively in the lateral and longitudinal directions to lay the hooks flat as the web 24 is advanced. Operation of the driver rollers is controlled by a dancer 206 similar to that on the web feed station so that it operated conjointly with the transfer mechanism.

A cutter 210 may be incorporated in the collection station and may be controlled by a transducer temporarily attached to the web 24 as it moves along the transfer station. A sensor senses the passage of the transducer and initiates the cutter whilst the web 24 is held stationary by a clamp bar 212. The completed roll may then be removed and the free end of the web may then be wound on the rollers to start a new roll.

In each embodiment therefore, the hooked tape 12 is sewn automatically to the web and the combination of the edge sensor and hook sensor ensures that the hooks in successive tapes are aligned. Webs may be formed from two overlapping strips as shown in FIG. 7 with the tape 12 acting to secure the strips to one another to form a unitary web. Additional components may be added to the web as the tape is sewn by using the sewing station as a transport for additional processor and integrating the operation of the sewing head with the processor.

The transfer mechanism provides control of the web as it is delivered to the collection zone where it may be automatically wound into a roll for dispatch.

If preferred, a driven shaft may be utilized at the collection station to control winding of the web 24 on to a core. In this case, operation of the shaft is controlled by a dancer, similar to the webfeed system 22.

Figure 17:
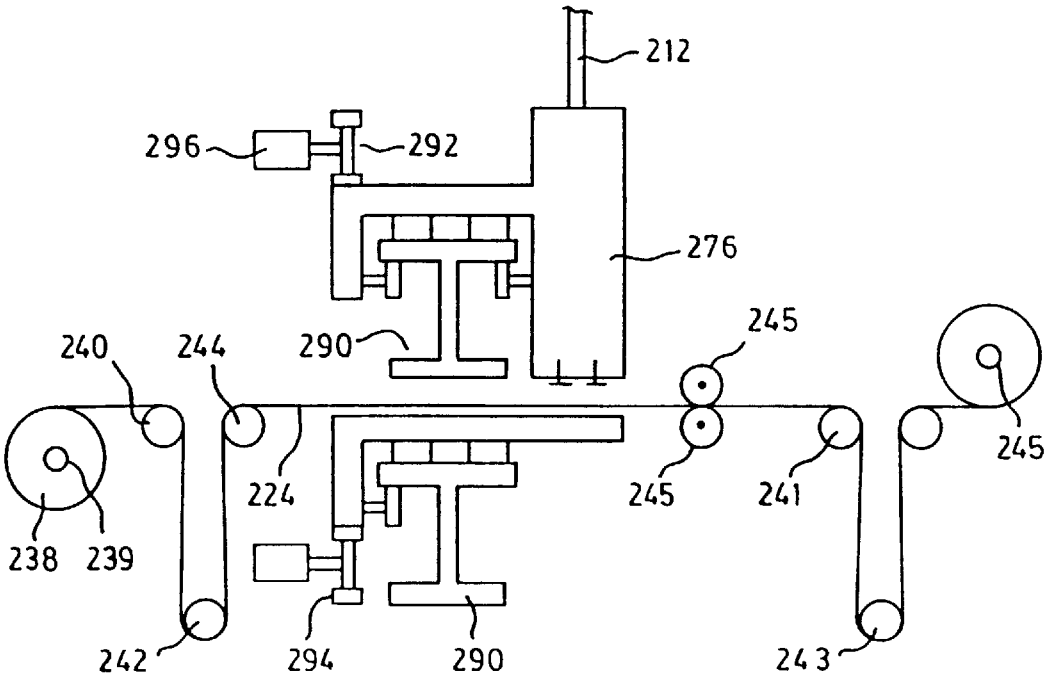
FIG. 17 is a side elevation of a further embodiment of machine.

An alternative embodiment is shown in FIG. 17 where a controlled web feed and web collections is used as a transfer mechanism in place of the beams 48, 56.

In the embodiment of FIG. 17, a roll 238 is supported on a driven shaft 239. The web 224 passes over an idler rollers 240, 244 and dancer 242 and between a pair of sewing machine head assemblies 276, 278. The web 224 passes over an idler roller 241 and dancer 243 for collection on a driven collection shaft 245. The web 224 is advanced by a pair of pinch rollers 247 that are grooved to allow passage of the hooks on tape 212.

The head assemblies 276, 278 are mounted on I beam 290 and driven by respective drives 292, 294, through servo motors 296, 298. The relative movement between the head assemblies is monitored and the servo motors adjusted to maintain the heads in alignment. Pre-hooked tape 212 is fed from a dispenser (not shown) associated with the head 276. The dispenser may be mounted on the head if preferred or may be remote from it.

In operation, the web 224 is fed by driving shaft 239 to advance web over the roller 240. Tension is maintained by dancer 242 and the length of web advanced is monitored by a shaft encoder associated with roller 240. The heads 276, 278 may then be advanced to sew a tape 212 as described above with the servo motors maintaining the heads 276, 278 aligned.

Upon completion of the sewing operation, the heads are returned and the web 224 advanced by pinch rollers 245. The collection shaft 243 is operated upon dancer 243 reaching a limit of travel to form a roll of web at the collection station.

In this embodiment, the transfer mechanism to advance the web is obtained through selective rotation of the roll on shaft 239 and corresponding take up at the collection station. If necessary a clamp bar may be incorporated in the roller 240 to maintain the tension in web 24 for sewing but it is believed that adequate control can be obtained from the driven shaft 239. The pinch rollers 245 may be used as necessary to assist in advancing the web.

What is claimed is:

1. A sewing apparatus to sew a tape having attachments located periodically therealong to a web, said apparatus comprising a web feed station to feed a web of material along a predetermined path, a sewing station having a sewing head and a drive to move said sewing head in a direction transverse to said predetermined path, a tape dispenser associated with said sewing head to deliver a tape to said sewing head for attachment to said web, a transfer mechanism to transfer said web from said sewing station to a collection zone and a control to control operation of said drive, said control including a sensor disposed between said tape dispenser and said sewing head to sense the passage of an attachment and initiate operation of said drive.

2. Apparatus according to claim 1 wherein said control includes an edge sensor responsive to detecting an edge of said web to position said sewing head at a predetermined location relative to an edge of said web.

3. Apparatus according to claim 1 wherein said transfer mechanism includes a clamp to inhibit movement of said web during transverse movement of said sewing head to attach said tape.

4. Apparatus according to claim 3 wherein said transfer mechanism includes a gripping device to engage said web and move it along said predetermined path.

5. Apparatus according to claim 4 wherein said gripping device translates along said path to move said web.

6. Apparatus according to claim 4 wherein said web feed station includes a selectively operable drive mechanism to supply said web during operation of said gripping device.

7. Apparatus according to claim 6 wherein said web feed station includes a pair of spaced parallel rollers to support a roll of said web, said drive mechanism rotating at least one of said rolls to dispense said web.

8. Sewing apparatus for sewing a tape to a web of material, said apparatus including a web feed station to feed a web of material along a predetermined path, a sewing station including a sewing head to attach said tape to said web and a drive to move said head transverse to said predetermined path, a transfer station to move said web from said sewing station to a collection zone, said web feed station including a first support for a first roll of web material and a second support for a second roll of web material, said supports being spaced apart in a direction transverse to said predetermined path, each of said rolls delivering a respective strip of web material with the spacing of said supports delivering said web material to said sewing station in side by side relationship, said sewing head traversing each of said strips to secure said tape thereto and form a unitary web.

9. Apparatus according to claim 8 wherein said supports are arranged to overlap adjacent edges of said strips.

10. Apparatus according to claim 9 wherein a guide is located on one of said supports to position one of said adjacent edges.

11. Apparatus according to claim 10 wherein the other of said supports is adjustable in a direction transverse to said path to vary the juxtaposition of said adjacent edges.

12. Apparatus according to claim 10 wherein said sewing head includes an edge sensor to determine the location of a lateral edge of said web, said edge sensor positioning said sewing head in a predetermined location relative to one of said edges prior to traversing said web.

13. Apparatus according to claim 8 wherein said transfer station includes a clamping member to inhibit movement of said strips when said sewing head traverses said web.

14. A sewing apparatus to sew a tape to a web, said apparatus comprising a web feed station to feed said web of material along a predetermined path, a sewing station having a sewing head and a drive to move said head in a direction transverse to said predetermined path, a tape dispenser associated with said sewing head to deliver a tape to said sewing head for attachment to said web, and a transfer mechanism to transfer said web from said sewing station to a collection zone, said sewing head carrying a supplementary mechanism to perform supplementary operations on said web as said head traverses said web.

15. Apparatus according to claim 14 wherein said supplementary mechanism includes a cutter and a drive to reciprocate said cutter in a direction normal to said web to pierce said web.

16. Apparatus according to claim 15 wherein said cutter is offset from said tape to pierce said web at a location spaced from said tape.

17. A sewing apparatus to sew a tape to a web, said apparatus including a web feed station to feed a web of material along a predetermined path, a sewing station having a sewing head and a drive to move said sewing head in a direction transverse to said predefined path, a tape dispenser to deliver a tape to said sewing head for attachment to said web, and a transfer mechanism to transfer said web from said sewing station to a collection zone, said sewing station including a pair of rails extending transversely to said predetermined path, a carriage supported on said rails by a pair of wheel assemblies, and a pedestal to mount said sewing head, said drive being operable to move said carriage along said rails to sew said tape to said web.

18. Apparatus according to claim 17 wherein said pedestal is formed, as a U and said web feed station is located in said U.

19. Apparatus according to claim 18 wherein one of said wheel assemblies is pivotally connected to said carriage for movement about an axis perpendicular to said rails.

20. Sewing apparatus for sewing a tape having attachments located periodically therealong to a web of material, said apparatus including a web feed station to feed a web of material along a predetermined path, a sewing station including a sewing head to attach said tape to said web and a drive to move said head transverse to said predetermined path, and a transfer station to move said web from said sewing station to a collection station, said collection station including a rolling device to receive one end of said web and form it into a roll and a cutter assembly to sever said web in a direction transverse to said predetermined path.

21. Sewing apparatus according to claim 20 including a plurality of shoes laterally spaced across said web and progressively converging therewith to lie said attachments parallel to said web.

22. A method of sewing a tape having attachments located periodically therealong to a web, said method including the steps of advancing said tape through a sensing head, sensing an attachment at a predetermined location and advancing said sewing head across said web to secure said tape to said web.

23. A method according to claim 22 including the step of positioning said head to one side of said web and moving said head over said web upon sensing said attachment.

24. A method according to claim 22 including the step of sensing an opposite edge of said web and terminating sewing.

25. A method according to claim 24 including the step of retracting needles in said sewing head upon termination of said sewing and returning said head across said web.

26. A method according to claim 22 including the step of advancing said web between successive passes of said head.

27. A method according to claim 22 including the step of rolling said web at a collection station.

28. A method according to claim 22 wherein said web is formed by a pair of partially overlapping strips and said method includes the step of adjusting said overlap as said web is advanced.

29. A method according to claim 22 including the step of performing auxiliary operations on said web as said sewing head advances across said web.

30. A method according to claim 29 wherein said auxiliary operation includes piercing said web.

31. A method of securing a tape having hooks disposed periodically along said tape to a web, said method comprising the steps of positioning a tape having hooks secured thereto adjacent to said web, advancing said tape with said hooks through a sewing head disposed adjacent said web, and advancing said sewing head across said web while performing a sewing operation between said tape and web to secure said tape to said web.

32. A method according to claim 31 including the step of advancing said web in a direction transverse to movement of said sewing head upon completion of a sewing operation.

33. A method according to claim 31 including the step of rolling said web at a collection station after said web is advanced.

34. A method according to claim 33 including the step of flattening said hooks against said web prior to rolling at said collection station.

35. A method according to claim 31 including the step of initiating movement of said sewing head across said web upon detection of a hook at a predetermined location.

* * * * *

UNITED STATES PATENT AND TRADEMARK OFFICE

CERTIFICATE OF CORRECTION

PATENT NO. : 6,125,777

DATED : October 3, 2000

INVENTOR(S) : Vollebregt et al

It is certified that error appears in the above-identified patent and that said Letters Patent are hereby corrected as shown below: On the title page, item:

In the Title

Delete the term "STRIP"

Column 1, line 1: delete "STRIP"

Signed and Sealed this

Eighth Day of May, 2001

*Attest:*

Nicholas P. Godici

NICHOLAS P. GODICI

*Attesting Officer*

*Acting Director of the United States Patent and Trademark Office*